United States Patent [19]

Staat et al.

[11] Patent Number: 4,501,134

[45] Date of Patent: Feb. 26, 1985

[54] ROLLING MILL PLANTS

[75] Inventors: Karl-Hans Staat, Homberg/Ratingen; Hermann Möltner, Grevenbroich, both of Fed. Rep. of Germany

[73] Assignee: Kocks Technik GmbH & Co., Hilden, Fed. Rep. of Germany

[21] Appl. No.: 493,216

[22] Filed: May 10, 1983

[30] Foreign Application Priority Data

Jun. 3, 1982 [DE] Fed. Rep. of Germany ..... 3220921

[51] Int. Cl.[3] ..... B21B 23/00

[52] U.S. Cl. ..... 72/8; 72/68; 72/78

[58] Field of Search ..... 72/68, 78, 205, 208, 72/209, 8, 370

[56] References Cited

U.S. PATENT DOCUMENTS

| | | | |
|---|---|---|---|
| 1,368,413 | 2/1921 | Stiefel | 72/78 |
| 3,735,617 | 5/1973 | Bretschneider | 72/78 |
| 4,033,164 | 7/1977 | Biller et al. | 72/205 |

FOREIGN PATENT DOCUMENTS

| | | | |
|---|---|---|---|
| 2556569 | 6/1977 | Fed. Rep. of Germany | 72/68 |
| 53-23856 | 3/1978 | Japan | 72/78 |
| 2019281 | 10/1979 | United Kingdom | 72/78 |
| 202851 | 9/1967 | U.S.S.R. | 72/78 |

*Primary Examiner*—Lowell A. Larson

*Attorney, Agent, or Firm*—Buell, Ziesenheim, Beck & Alstadt

[57] ABSTRACT

A rolling mill plant has a planetary skew rolling mill and a reducing or sizing rolling line disposed at a short distance therebeyond for the purpose of manufacturing tubes. In order to avoid axial stressing of the work material between the planetary skew rolling mill and the reducing or sizing rolling line when the work material is simultaneously located in both of them, a tension and compression measuring device is disposed in the region of the reducing or sizing rolling line for the purpose of corresponding regulation of the latter's drive motor. A torque measuring device is disposed between the mounting of the mandrel rod of the planetary skew rolling mill in order to be able to detect torque stresses in the work material which are then eliminated in dependence upon the measured values of the torque measuring device by corresponding regulation of the rotational speed of the rolls and of the rotor of the planetary skew rolling mill.

4 Claims, 2 Drawing Figures

ROLLING MILL PLANTS

The present invention relates to a rolling mill plant and particularly to a rolling mill plant having a planetary skew rolling mill and a rolling line situated beyond the planetary skew rolling mill.

In a planetary skew rolling mill, it is possible to adapt the delivery speed of the work material to a reducing or sizing rolling line disposed therebeyond. Consequently, it is also possible to dispose the reducing or sizing rolling line at only a very short distance beyond the planetary skew rolling mill, so that there is only a small amount of heat loss from the work material between the planetary skew rolling mill and the reducing or sizing rolling line disposed therebeyond. This was already known in a rolling mill plant for the manufacture of seamless tubes; see German Patent Specification (Offenlegungschrift) No. 26 57 832; although this Offelegungsschrift does not give any thought as to how coördination between the planetary skew rolling mill and the reducing or sizing rolling line disposed therebyond is to be effected.

It is obvious that poor coordination of the planetary skew rolling mill with the reducing or sizing rolling line disposed thereafter results in considerable additional stresses in the work material in the region between these two parts of the rolling mill plant, namely when the leading end of the work material is already located in the reducing or sizing rolling line or has already passed therethrough, while a central or trailing length of the work material is still located in the planetary skew rolling mill. This can lead to undesirable changes in shape and, in an extreme case, even to rupture of the work material. The aforesaid difficulties have already been recognized in a rolling mill plant of this kind for the rolling of bars or wire; see German Patent Specification (Offenlegungsschrift) No. 27 45 684.

The invention is based on the last-mentioned known rolling mill plant having a planetary skew rolling mill and a reducing or sizing rolling line disposed at a short distance therebeyond, and in which, in order to avoid stressing of the work material in the region between the planetary skew rolling mill and the reducing or sizing rolling line, at least one of the drives is regulated in dependence upon the measured value of a measuring device which measures axial or longitudinal stresses in the work material between the planetary skew rolling mill and the reducing or sizing rolling line respectively in, or in the opposite direction to, the rolling direction.

In this known type of construction, the drive of the planetary skew rolling mill is regulated in dependence upon the measured value of a measuring device which is also disposed on the planetary skew rolling mill. It is located below the planetary skew mill in the base frame thereof and measures the forces which seek to displace the planetary skew rolling mill in, or in the opposite direction to, the rolling direction. These forces additionally stressing the work material are compensated for by varying the rotational speed of the rotor and of the rolls of the skew rolling mill in dependence upon the measured values of this measuring device, so that the delivery speed of the work material is increased or reduced relative to the entry speed of the reducing or sizing rolling line according as to whether the measuring device detects tensile forces or compressive forces which act upon the planetary skew rolling mill by way of the work material. Regulation in this sense is necessary, since the deformation behavior of the work material and the friction conditions between the work material and the rolls within the planetary skew rolling mill and within the reducing or sizing rolling line continuously change, and therefore the delivery speeds of the planetary skew rolling mill and the entry speeds of the reducing or sizing rolling line fluctuate Differences of cross section of the work material entering the plant, and temperature fluctuations, can also be the cause of such changes in the entry and delivery speeds.

However, this known rolling mill plant is provided for the rolling of rods and is not suitable for the reduction of tubular blooms to form tubes since, for this purpose, a mandrel rod would have to be inserted into the planetary skew rolling mill and would have to be retained by means of a mounting. Consequently, axial friction forces would occur between the mandrel rod and the work material and would be absorbed by the bed plate not by way of rolls of the skew rolling mill but by way of the mounting of the mandrel rod. The measured values of the measuring device in the region of the base frame of the planetary skew rolling mill would be falsified by the mandrel rod and its mounting and would be useless for regulating the drive of the planetary skew rolling mill. Furthermore, this known rolling mill plant has the disadvantage that the torques which stress the work material are not measured and compensated for when the rotational speed of the rotor and the rotational speeds of the rolls in the planetary skew rolling mill are not sufficiently accurately.matched to one another in the required manner. These torques occur chiefly as a result of the same above-mentioned irregularities in the deformation of the work material, such as the tensile and compressive forces, and stress the work material to a considerable extent if they are not continuously compensated for by a regulating device provided for this purpose.

An object of the invention is to provide a rolling mill plant having a planetary skew rolling mill and a reducing or sizing rolling line disposed at short distance therebeyond for reducing tubular blooms to form tubes, in which plant the work material is kept largely free from stress between the planetary skew rolling mill and the reducing or sizing rolling line.

In accordance with the invention, a rolling mill plant comprises a planetary skew rolling mill and a reducing or sizing rolling line which is disposed a short distance therebeyond, in which the planetary skew rolling mill is provided with a mandrel rod and is constructed for rolling tubular blooms, and with a torque measuring device for regulating the planetary skew rolling mill drive which is operative between the mandrel rod and its mounting, and in which the reducing or sizing rolling line has a tension and compression measuring device which is effective in, or in the opposite direction to, the rolling direction to measure the axial load in the work material and which regulates the drive of the reducing or sizing rolling line, whereby stressing of the work material in the region between the planetary skew rolling mill and the reducing or sizing rolling line may be avoided.

This in the first instance results in the drive for the rotor and the drive for the rolls of the planetary skew rolling mill being regulated by separate measuring and regulating devices such that the work material already delivered from the planetary skew rolling mill is not subject to any stress by torque. As soon as such torque occurs, it also acts upon the mandrel rod which then seeks to jointly rotate as a result of the friction between the interior surface of the work material and the exterior surface of the mandrel. The torque thus occurring in the mandrel rod is detected at the region of its mounting by the torque measuring device and immediately leads to corresponding correction of the drive of the planetary skew rolling mill, in the sense of varying either the rotational speeds of the rotor or the rotational speeds of the rolls.

In order also to be able to compensate for the tensile and compressive forces, the reducing or sizing rolling line is equipped with a tension and compression measuring device which, in contrast to this was provided on the planetary skew rolling mill in the known type of construction. A measuring device of this kind need not be provided on the planetary skew rolling mill in the plant in accordance with the invention. It is more advantageous to dispose the tension and compression measuring device on the reducing or sizing rolling line instead of disposing it on the planetary skew rolling mill. Namely, in a planetary skew rolling mill provided for the reduction of tubes, a proportion of the tensile and compressive forces occurring is taken up directly by the bed plate by way of the mounting of the mandrel rod. However, with analogous use of the know type of construction for tubes, these tensile and compressive forces would additionally have to be measured and subtracted from the forces acting directly on the planetary skew rolling mill in a horizontal direction. This would involve considerable additional expenditure and would impair the accuracy of measurement and regulation. The arrangement of the tension and compression measuring device only on the reducing or sizing rolling line avoids these difficulties, reduces the expense and results in high accuracy of measurement and regulation. This is particularly important when rolling tubes, since there is the additional factor of variable friction between the mandrel rod and the work material, and since the cross section of the work material experiencing the additional stresses is smaller and therefore more sensitive than the full cross section when reducing rods. Additional stresses on the tubular cross section of the work material in the region between the planetary skew rolling mill and the reducing or sizing rolling line readily result in undesirable variations in the wall thickness which constitutes a crucial feature of the quality of the finished product.

In the foregoing general description of our invention we have set out certain objects, purposes and advantages of the invention. Other objects purposes and advantages of this invention will be apparent from a consideration of the following description and the accompanying drawings in which.

Figure 1:
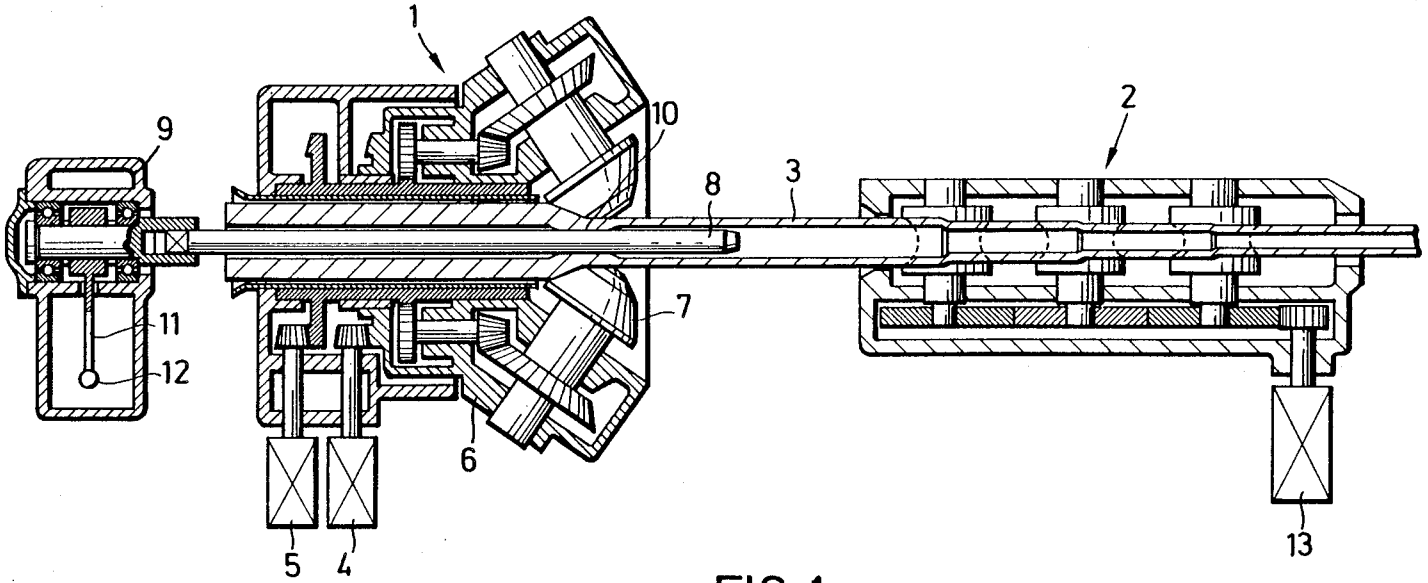
FIG. 1 is a horizontal section through a rolling mill plant.

Referring to FIG. 1, a reducing or sizing rolling line 2 is disposed at the short distance beyond a planetary skew rolling mill 1. The work material comprises a tube 3 whose trailing end portion is still located in the planetary skew rolling mill 1, while its finished-rolled leading portion has already left the reducing or sizing rolling line 2.

Figure 2:
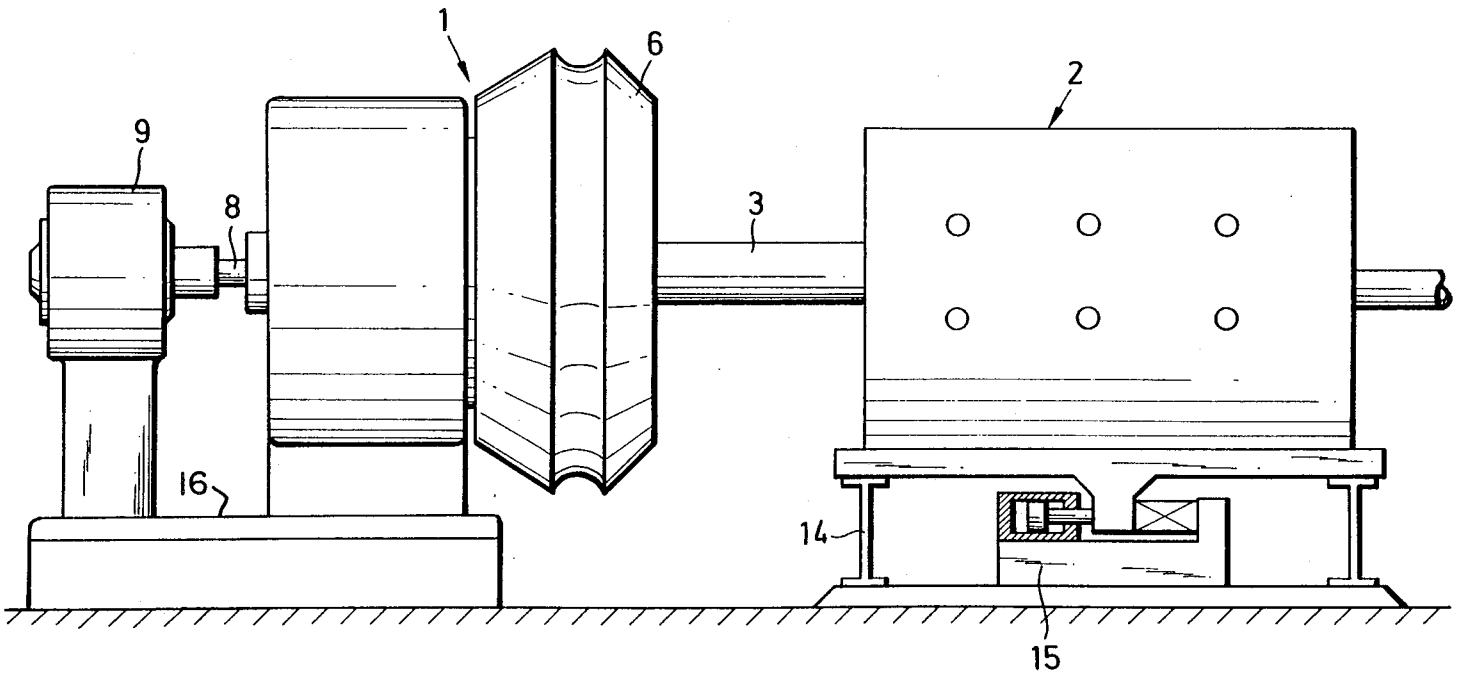
FIG. 2 is a side elevation of the plant of FIG. 1.

The planetary skew rolling mill 1 has two separately regulable drive motors 4 and 5. The motor 4 drives the rotor 6 in which the rolls 7 are mounted. The rolls 7 themselves are driven by the motor 5. A mandrel rod 8 is inserted into the interior of the tube 3 and is held by a mounting 9 which is itself mounted on the same bed plate 16 as the planetary skew rolling mill, as shown in FIG. 2. The mounting 9 absorbs the axial forces as well as the radial forces and also the torques which occur as a result of the friction at the location 10 between the mandrel rod 8 and the tube 3. These torques only occur when the rotational speeds of the rotor 6 and of the rolls 9 are not accurately matched to one another. A torque arm 11 in the mounting 9 transmits this torque of the mandrel rod 8 to a torque measuring device 12 whose measured values are used in a known manner for regulating the motors 4 and/or 5 of the planetary skew rolling mill 1, such that the torque occuring is reduced to zero.

The reducing or sizing rolling line 2 is driven by a motor 13 which is also regulable. As is shown in FIG. 2, the reducing or sizing rolling line 2 has in the region of its base frame 14 a tension and compression measuring device 15 of known construction whose measured values cause the motor 13 to run more rapidly or more slowly upon the occurrence of tensile or compressive forces in the work material. In this manner, tensile forces, for example, in the tube 3 can be reduced by allowing the drive motor 13 of the reducing or sizing rolling line 2 to run more slowly. This is caused by the tension and compression measuring device 15 when it has established that the reducing or sizing rolling line 2 is being drawn towards the planetary skew rolling mill 1.

In the foregoing specification we have set out certain preferred practices and embodiments of this invention, however, it will be understood that this invention may be otherwise embodied within the scope of the following claims.

We claim:

1. A rolling mill plant for rolling tubular product comprising a planetary skew rolling mill and a reducing or sizing rolling line which is disposed a short distance therebeyond on a common pass line, drive means for driving said planetary skew rolling mill, drive means for said reducing or sizing roll line, a mandrel rod in said planetary skew rolling mill for rolling tubular blooms therein, mounting means adjacent said planetary skew rolling mill for holding said mandrel, a torque measuring device at the mandrel mounting means for regulating the planetary skew rolling mill drive means operatively connected between the mandrel rod and its mounting means, a tension and compression measuring device operatively connected to the reducing or sizing rolling line which is effective in either direction relative to the rolling direction to measure the axial load in the work material and which regulates the drive of the reducing or sizing rolling line, whereby stressing of the work material in the region between the planetary skew rolling mill and the reducing or sizing rolling line is avoided.

2. A rolling mill plant as claimed in claim 1 wherein the drive means for the planetary skew rolling mill is two separately regulatable drive motors.

3. A rolling mill plant as claimed in claim 2 wherein one motor drives a rotor in which the rolls are mounted and the other motor drives the rolls for rotation about their axis.

4. A rolling mill plant as claimed in claim 1 or 2 or 3 wherein the mandrel mounting means is fixed to a common bed plate with the planetary skew rolling mill.

* * * * *